US005340045A

United States Patent [19]

Arabian et al.

[11] Patent Number: 5,340,045

[45] Date of Patent: Aug. 23, 1994

[54] METHOD FOR THE SEQUENTIAL PROVISION OF PORTIONS OF A TOWEL WEB

[75] Inventors: Sandro Arabian, Vaduz; Manfred Baumann, Diepoldsau, both of Switzerland

[73] Assignee: CWS International AG, Baar, Switzerland

[21] Appl. No.: 820,663

[22] PCT Filed: May 3, 1991

[86] PCT No.: PCT/CH91/00106

§ 371 Date: Mar. 16, 1992

§ 102(e) Date: Mar. 16, 1992

[87] PCT Pub. No.: WO91/17692

PCT Pub. Date: Nov. 28, 1991

[30] Foreign Application Priority Data

May 15, 1990 [CH] Switzerland ..... 1681/90

[51] Int. Cl.[5] ..... B65H 16/00

[52] U.S. Cl. ..... 242/535.2; 312/34.12

[58] Field of Search ..... 221/33; 312/34.12, 34.11, 312/34.13, 34.9; 242/55, 55.17, 180, 186, 55.2, 55.53

[56] References Cited

U.S. PATENT DOCUMENTS 4,826,262 5/1989 Hartman et al. ..... 312/34.12

4,848,854 7/1989 Kennedy ..... 312/34.12

FOREIGN PATENT DOCUMENTS 561535 1/1992 Switzerland .

*Primary Examiner*—Kenneth W. Noland

*Attorney, Agent, or Firm*—Egli International

[57] ABSTRACT

In a towel dispenser, a selection can be made between a standard program, in which, to form a towel loop, first a portion of unused towel and subsequently a shorter portion of used towel is released, and a hygiene program, in which only unused towel is released. In both cases, a movement sensor monitors whether the towel is moved as a result of external action, and if this is so the towel portion is drawn in as used 3 seconds after the movement has ceased. If the towel, after being dispensed, is not moved for 20 seconds, it is retracted as unused. In both cases, economy programs with a dispensing of shorter towel portions can be selected. Within the standard program, a selection can be made between a normal program, in which used towel is first drawn in and subsequently unused towel is provided, and a fast program, in which the dispensing of unused towel takes place first. Where the tripping of towel dispensing is concerned, a selection can be made between a trip by the movement sensor, which, in the state of rest, detects movements imparted to a short loop, or a trip by an infrared sensor. In the fast program, the towel dispensing takes place without a trip.

10 Claims, 8 Drawing Sheets

METHOD FOR THE SEQUENTIAL PROVISION OF PORTIONS OF A TOWEL WEB

The invention relates to a method for the sequential provision of portions of a towel web by means of a towel dispenser according to the pre-characterising clause of claim 1. Methods of this kind serve for providing a user with towel portions for drying his hands.

There is a known method of the relevant generic type (CH-A-561,535), in which both used and unused towel is released automatically via a towel dispenser in response to a trip. In this system, even if the user uses the front part of the loop consisting of unused towel, it is nevertheless very easily possible that he will also touch the used part of the towel. This is of no importance in normal hygiene requirements. However, in the medical and care sector and, for example, in industrial food production, the hygiene requirements are considerably more stringent than at the customary locations of towel dispensers. There, the possibility that the user will come in contact with used towel has to be preventable. Furthermore, used towel should be drawn in immediately so that bacteria which have possibly settled on it cannot spread.

On the other hand, it is highly undesirable for economic and ecological reasons to use more towel web than is necessary. The aim is, therefore, even where it is perfectly acceptable if a user touches used towel, to prevent the towel loop always being formed from unused towel only.

The invention is intended to remedy this. The invention, as characterised in the claims, provides a method in which the towel dispensing can be adapted to particular local needs or else those which change in the course of time.

The advantages of the invention are to be seen, above all, in that it affords the possibility of catering in a controlled way for special conditions of use, particularly those with special hygiene requirements, by means of special programs which can be selected by the maintenance or assembly personnel or the manager. Even the replacement of used towel webs by unused ones can be assisted by means of a program and thus simplified and speeded up.

When a suitable towel dispenser is employed, the programs can be so designed that dispensed but unused towel is retracted. In general, a more economical use of clean towel and therefore longer washing intervals are achieved, this being desirable from both economic and ecological points of view.

Figure 1:
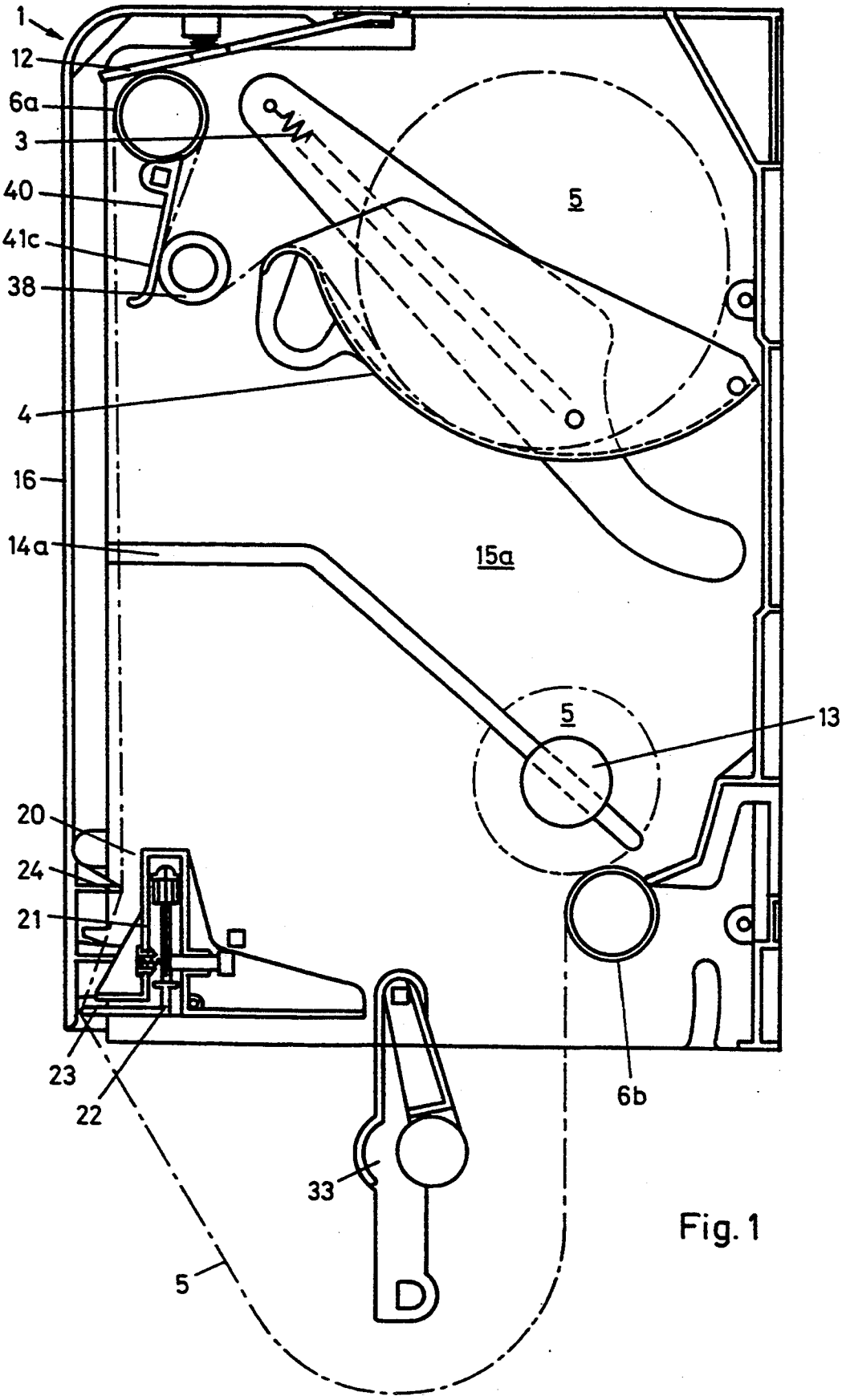
Figure 2:
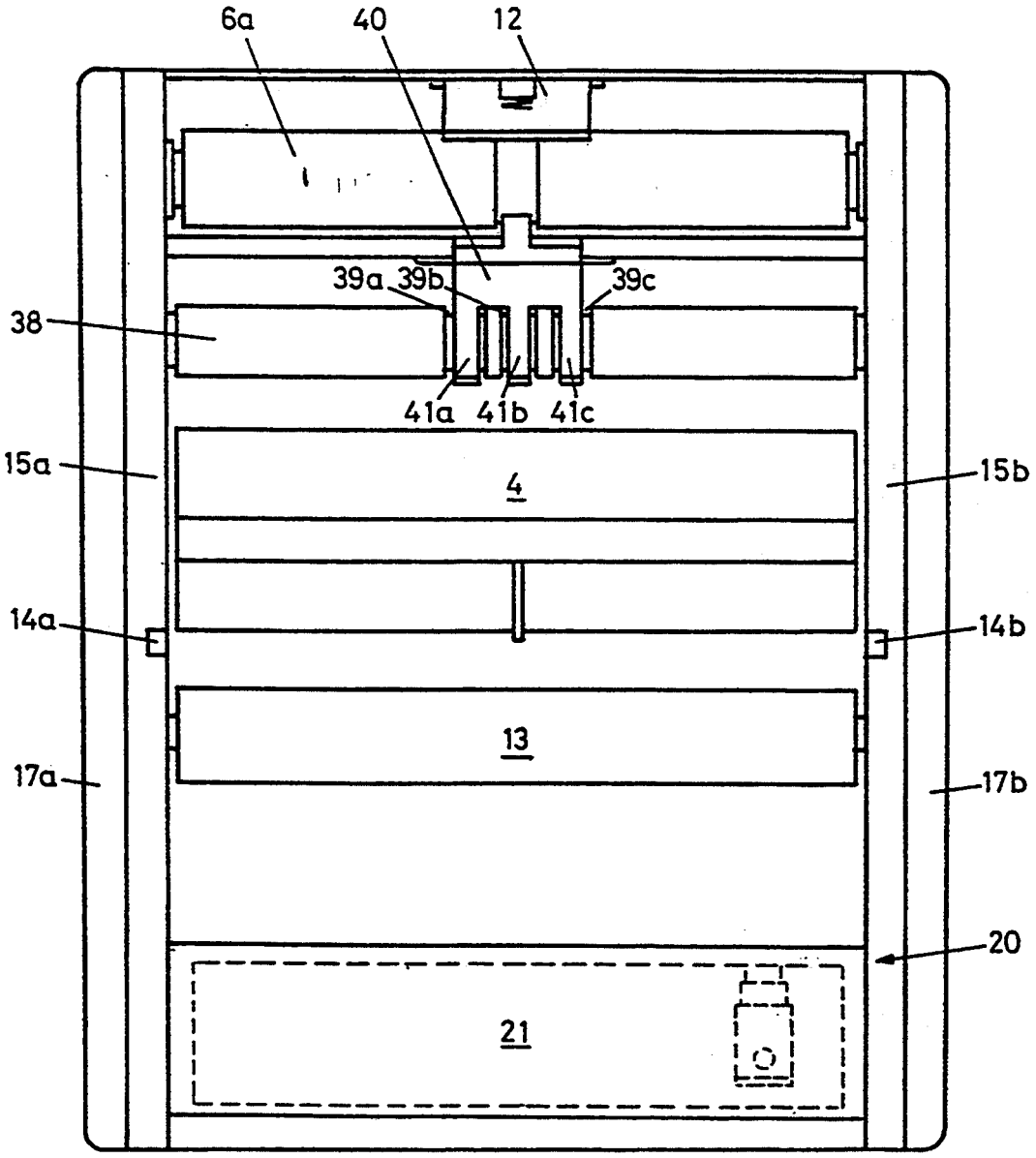
Figure 3:
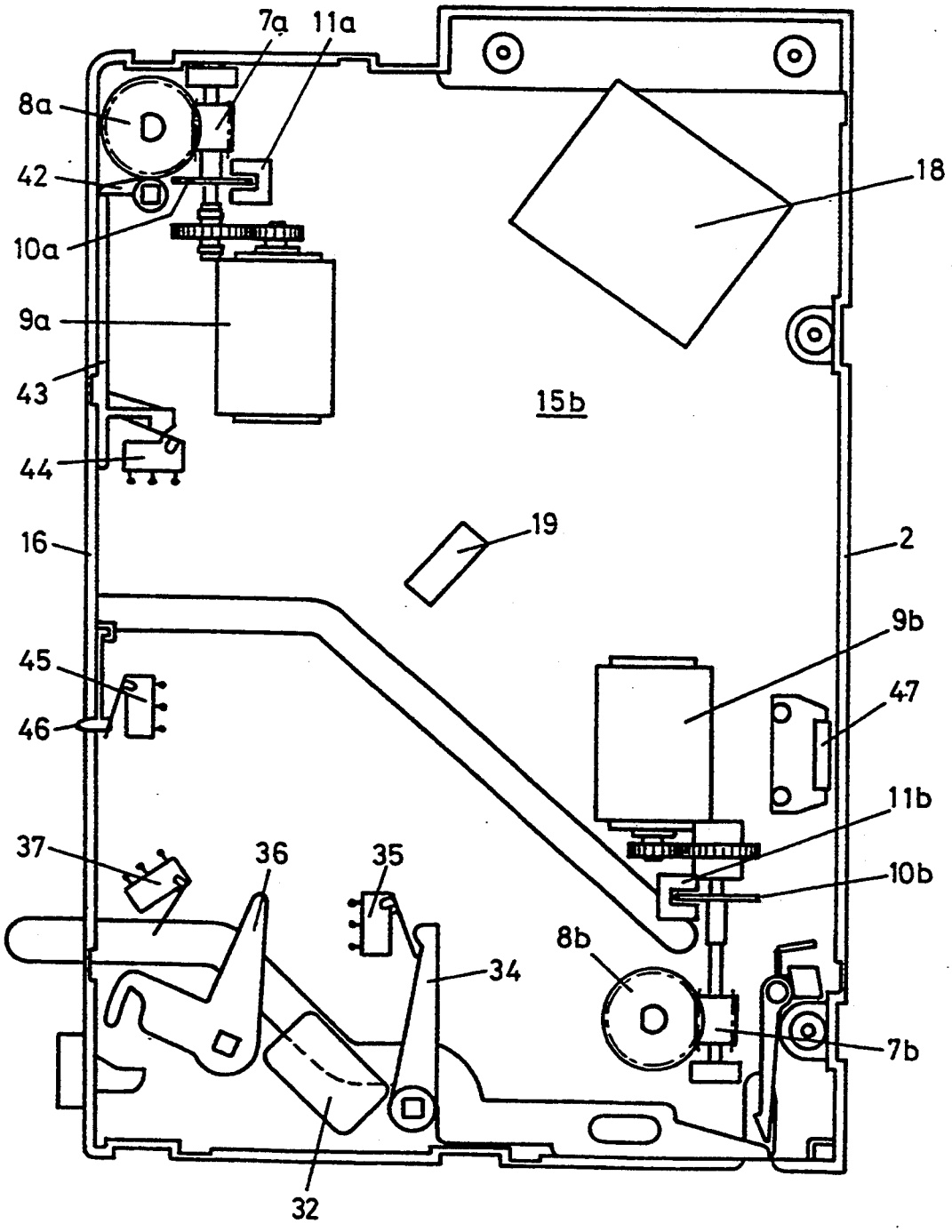
Figure 4:
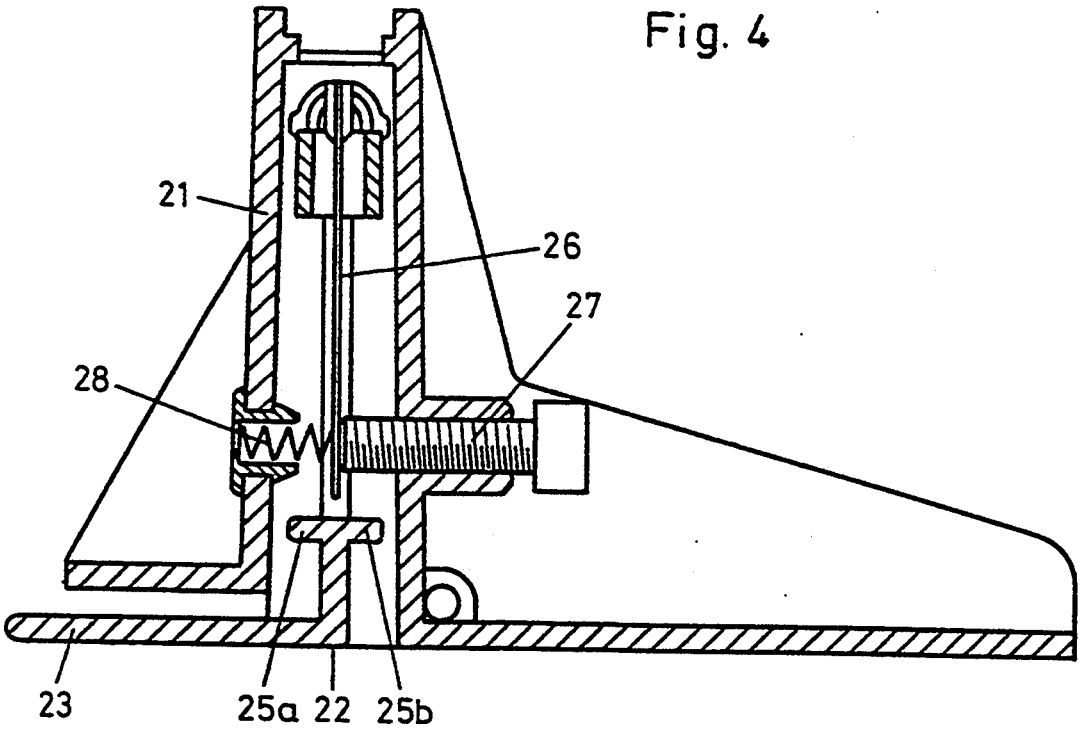
Figure 5:
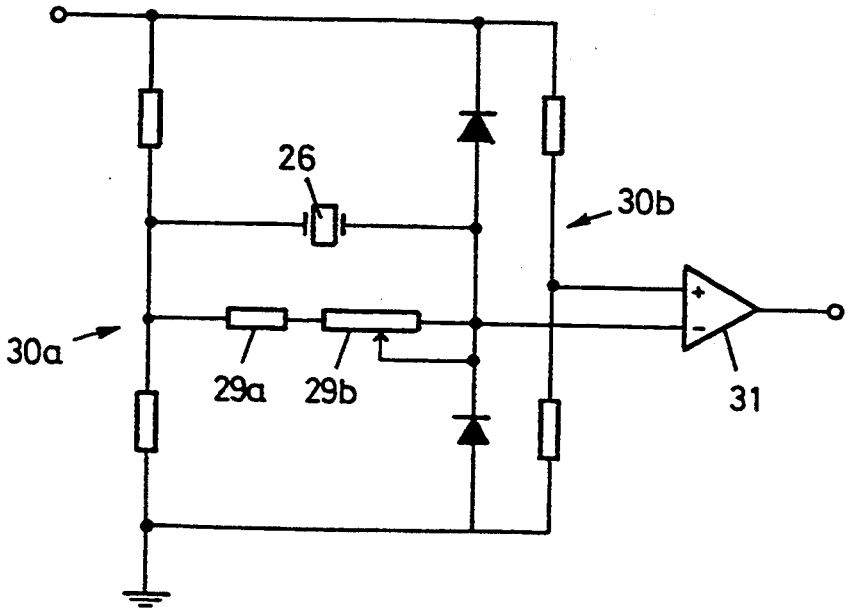
Figure 6:
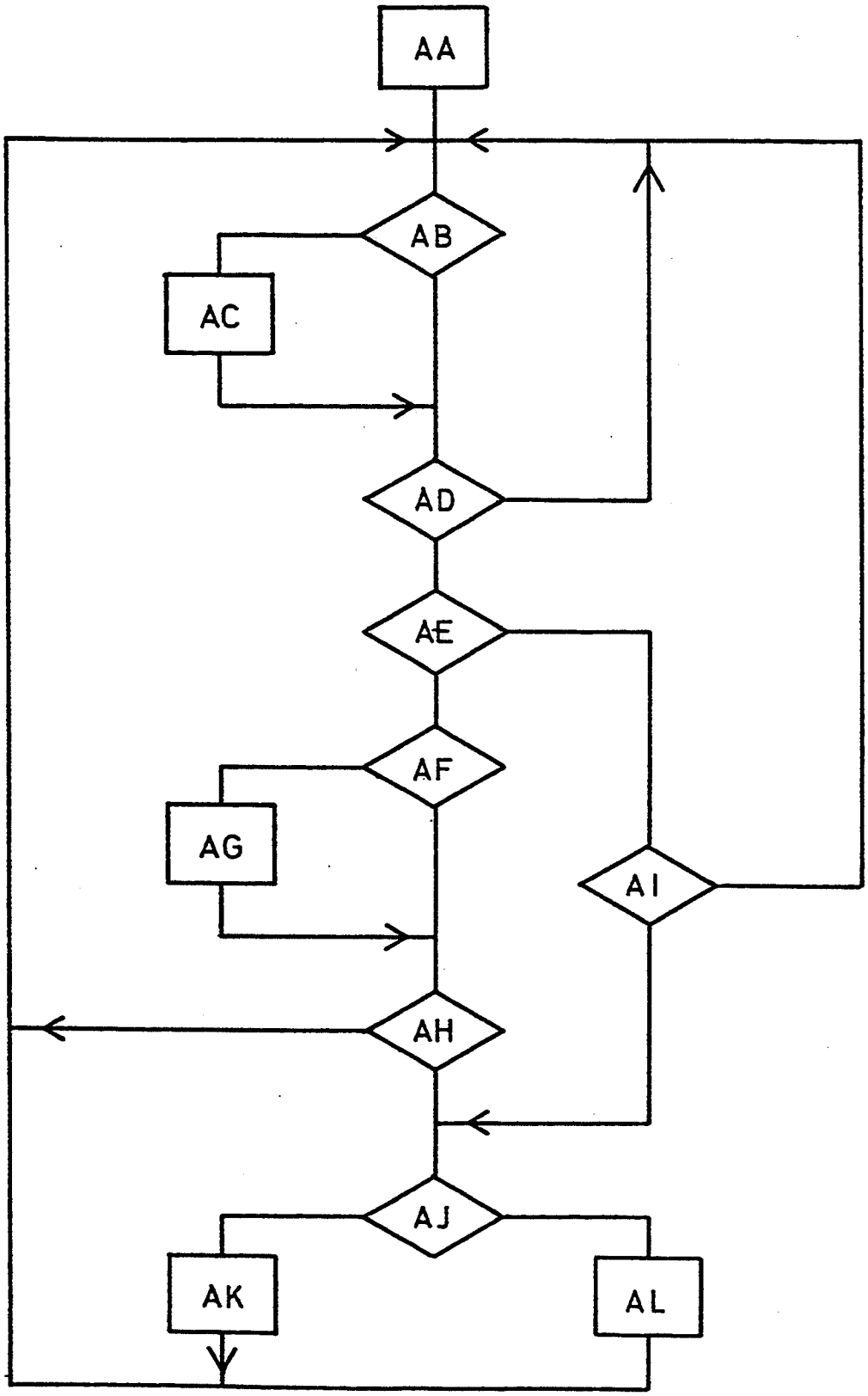
Figure 7A:
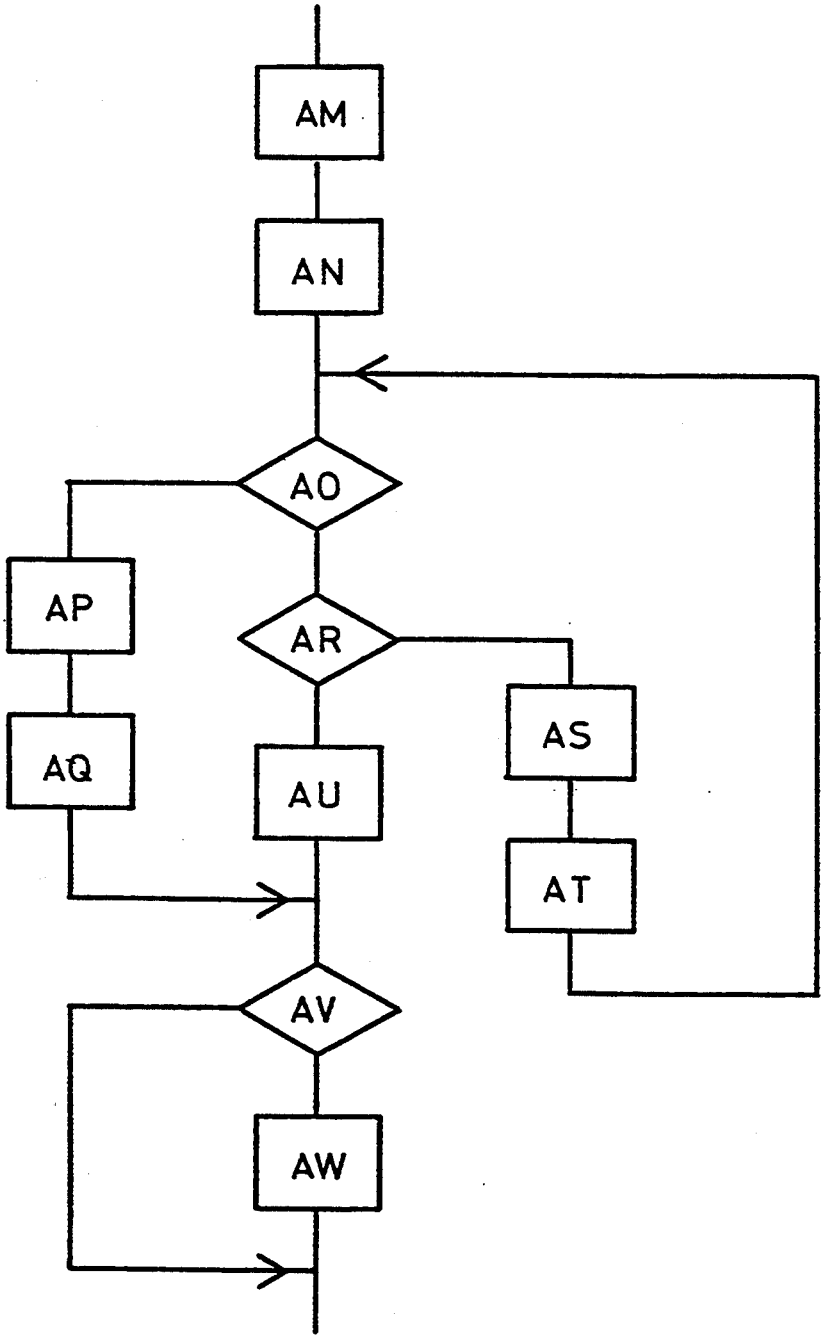
Figure 7B:
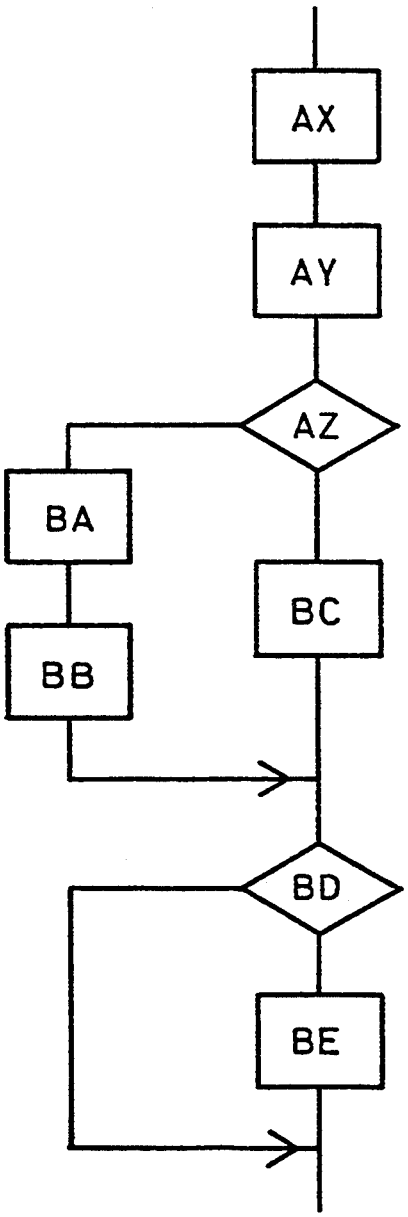
Figure 8:
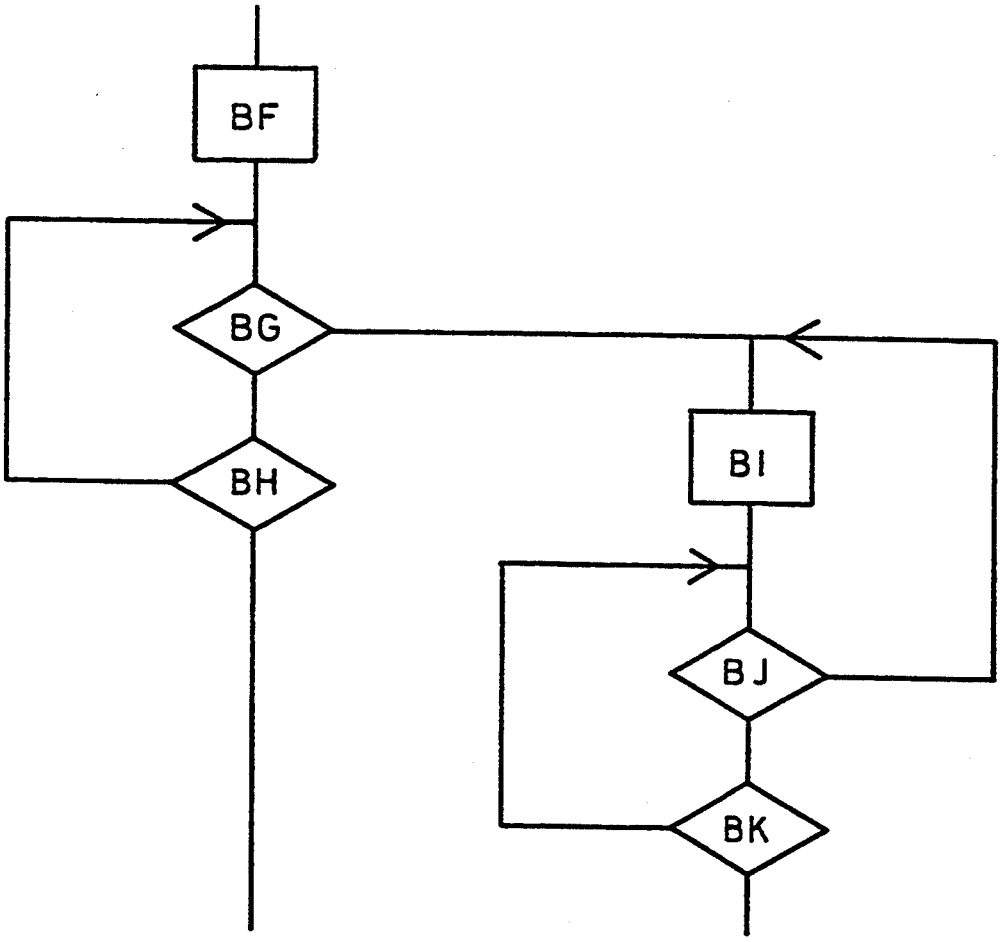

The invention is explained in more detail below by means of Figures illustrating merely an exemplary embodiment, a towel dispenser especially suitable for carrying out the method also being shown in detail. Of the Figures FIG. 1 shows a side view of the right-hand side of a towel dispenser with towel inserted, the side wall being omitted, FIG. 2 shows a front view of the towel dispenser, a front cover being omitted, and FIG. 3 shows a top view of the right-hand side wall of the towel dispenser, a lateral cover being omitted, FIG. 4 shows, enlarged, a cutout from FIG. 1 illustrating a movement sensor, FIG. 5 shows a circuit belonging to the movement sensor, FIG. 6 shows a flow diagram illustrating the method according to the invention, above all the parts run through in a state of rest being shown in detail, FIG. 7*a* shows a flow diagram illustrating in detail the steps run through after a trip in a standard program, FIG. 7*b* shows a flow diagram illustrating in detail the steps run through after a trip in a special hygiene program, and FIG. 8 shows a further flow diagram illustrating in detail the detection of a use of the towel.

FIGS. 1 to 5 show a towel dispenser comprising, in a housing 1 mounted on a wall by means of its rear wall 2, a tiltably suspended shell 4 loaded by springs 3 with an upwardly acting force and intended for receiving an unused towel web 5 (represented by a dashed line) wound to form a roll, as well as a first transport device with a transport roller 6*a* which is covered with knobbed rubber and which is driven from an electric motor 9*a* via a worm gear consisting of a worm 7*a* and of a gearwheel 8*a* connected to the transport roller 6*a*. A half-disc 10*a* fastened to the worm 7*a* forms, with a fixed light barrier 11*a* detecting passages of the half-disc 10*a*, a revolution counter. The gearwheel 8*a* is connected to the transport roller 6*a* via a slip coupling which responds when a pull of more than 4 kp acts on the towel 5. The towel 5 is pressed against the transport roller 6*a* by a sprung pressure plate 12. A second drive device is constructed in a similar way to the first with a transport roller 6*b*, a worm gear with worm 7*b*, gearwheel 8*b* and electric motor 9*b* and a revolution counter with a half-disc 10*b* and a light barrier 11*b*. For receiving used towel, a roller 13 is guided in slots 14*a,b* in side walls 15*a,b* of the housing 1. The housing is closed at the front by means of a cover 16 which is secured by a lock, so that it can be opened only by authorised personnel for maintenance purposes, especially for a towel change. The housing 1 possesses on its sides covers 17*a,b*. The power supply of the appliance is guaranteed by a power unit 18.

The towel dispenser has a central control unit 19 which processes the signals from various sensors and which, in particular, controls the transport devices. To determine movements of the towel 5 caused by external action, the towel dispenser has a movement sensor 20 with a bar 22 which is suspended rotatably in a sensor housing 21 and at the lower end of which projects horizontally a batten 23, over the front end of which the towel 5 is so guided by means of a deflecting fence 24 that, even in the non-tensioned state, because of its own weight it exerts a force on this. The bar 22 is suspended in such a way that, in the event of deflections, a return force occurs which ensures that it is deflected only a little out of its vertical position of rest by the forces exerted on it by the towel 5 at rest. Under higher forces transmitted by the towel 5, stops 25*a,b* limit the deflection. Mounted in a rectangular recess of the bar 22 is a piezoelectric element 26 which is designed as a rectangular strip and which with a first contact region is clamped firmly at its upper edge in the bar 22 and in a second contact region in the vicinity of its lower end is clamped between a threaded bolt 27 screwed into the sensor housing 21 and a helical spring 28 coaxial with the threaded bolt 27 and likewise fastened to the sensor housing 21. The threaded bolt can be adjusted perpendicularly relative to the plane of the piezoelectric element 26 by rotation. Since the elastic piezoelectric element 26 provides at least some of the return force for the bar 22, the neutral position of the bar 22 can therefore be adjusted. The output signal for the piezoelectric element 26 is processed in the circuit shown in FIG. 5, which essentially constitutes a limit-value detector. Under a constant bending moment, the piezoelectric element 26 is electrically inactive. Changes of the bending moment, which are caused by movements of the bar 22 brought about by external actions on the towel 5, give rise to a current surge. It has been shown, in practice, that a change of the bending moment in one direction is always followed very quickly by a change in the opposite direction, so that current surges of differing sign always succeed one another rapidly, and therefore only one of these need be detected. The piezoelectric element 26 is connected in parallel to the resistors 29*a,b* which serve for deriving the current surge and of which 29*b* can be varied to adjust the voltage generated by the piezoelectric element 26, between a first voltage divider 30*a* and the negative input of a comparator 31, to the positive input of which the output of a second voltage divider 30*b* is applied. The voltage dividers are at a supply voltage of +5 V and are so designed that the output voltage of the second voltage divider 30*b* is somewhat lower than that of the first voltage divider 30*a*, with the result that the output of the comparator 31 is normally at "zero". Now if a sufficiently strong voltage surge of negative polarity caused by the piezoelectric element 26 is superposed on the output voltage of the first voltage divider 30*a*, the voltage at the negative input of the comparator 31 falls below the output voltage of the second voltage divider 30*b* applied to the positive input, so that the output signal of the comparator 31 jumps to "one".

An infrared sensor 32 monitors the space sector located underneath to obliquely underneath the towel dispenser for heat-radiating objects.

A rotatably suspended flap 33, around which the towel 5 is guided, is connected to a lever 34 which activates a microswitch 35 when the towel 5 is fully tensioned and presses the flap 33 completely upwards. A further lever 36 interacts with a further microswitch 37. The lever 36 actuates the microswitch 37 when the lock (not shown) is blocked. The blocking of the lock is only possible when the cover 16 is closed.

Between the shell 4 and the transport roller 6*a*, the towel 5 is guided via a roller 38 which has three continuous grooves 39*a,b,c*. A feeler 40 suspended rotatably on an axle parallel to the roller 38 has three fingers 41*a,b,c* which are pressed against the grooves 39*a,b,c* under the influence of spring force acting on the feeler 40. When the towel end passes the roller 38, the fingers 41*a,b,c* can be pressed onto the bottom of the grooves 39*a,b,c*, and the feeler 40 executes a rotation in the anticlockwise direction. A lever 42 connected to it thereby actuates a microswitch 44 via a connecting rod 43. A further microswitch 45 detects actuations of a starting-aid button 46. All the sensors and microswitches are connected to the control unit 19.

A plug 47 serves for connecting the towel dispenser to a second towel dispenser of the same type normally mounted next to it.

The method according to the invention is explained below by means of FIGS. 6 to 8.

At AA in FIG. 6, for example after the towel dispenser has been switched on, the control unit 19 is initialised, whereupon it executes various initialisations and checks of further elements. Upon conclusion of these operations, at AB the microswitch 37 is interrogated, that is to say it is ascertained whether the cover 16 is closed and blocked. If not, it is assumed that a fresh towel web is being loaded, and the check passes on to a towel-loading program AC.

The towel change takes place, in that, first, after the complete opening of the cover 16, the roller 13, on which the used towel is wound, is drawn forwards out of the slots 14*a,b*, then the shell 4 is tilted downwards and the fresh towel roll inserted, and thereafter the towel 5 is drawn through between the roller 38 and the feeler 40 and subsequently over the transport roller 6*a*. The starting-aid button 46 is then actuated, this causing approximately 1.3 m of towel to be released by the first transport device. The towel end is then wound around a new roller 13, and this is moved around the movement sensor 20 and the flap 33 and introduced with its ends into the slots 14*a,b*, until it or the towel wound on it touches the transport roller 6*b*. Subsequently, the flap 33 is pressed upwards and the cover 16 is closed and blocked, this being recorded by the microswitch 37 and triggering a complete drawing in of the towel 5, with the exception of a towel residue, by the second transport device. The microswitch 35 indicates to the control unit 19 that the towel 5 is completely drawn in, that is to say tensioned, whereupon the control unit stops the electric motor 9*b*. The towel-loading program AC is thus terminated, and the check passes on to AD. If it is ascertained at AB that the cover 16 is closed and blocked, the check passes directly on to AD. At AD, the state of the microswitch 44 is interrogated and it is ascertained whether the towel end is reached or whether there is still a stock of fresh towel. If the towel end is reached, a pilot lamp on the housing 1 lights up and the check returns to AB. Thereafter, there is only a periodic check as to whether the cover 16 is closed and blocked or is open.

If there is still towel available, a check is conducted at AE as to which trip mechanism has been selected for the release of towel. There are two possibilities here: the trip can be made by the infrared sensor 32 which indicates when a person probably wanting to use the towel dispenser approaches, or by the movement sensor 20 which records movements of the towel 5. In the first instance, the check passes on to AF, where it is ascertained by means of the microswitch 35 whether the towel 5 is tensioned. If not, at AG the second transport device is activated, until the periodic check produces a positive result. In this case, in the same way as with the result positive from the outset, the program goes on to AH, where a check is made as to whether the infrared sensor 20 responds. If not, the check returns to AB. If a trip by the movement sensor 20 has been selected, this being advisable, above all, in confined conditions to prevent faulty trips, the check passes from AE to AI, where a check is made in the way already described above as to whether the movement sensor 20 indicates that the towel has been touched. To allow this type of trip, whenever the towel 5 has been tensioned, a piece of towel of a length of 8 cm is released by the first transport device, so that the accessible towel residue forms a short loop which the user can grasp.

In the state of rest, that is to say as long as there has been no trip, the program parts described hitherto are run through periodically. In the event of a trip, irrespective of whether it has been caused by the infrared sensor 32 or by the movement sensor 20, the check passes on to AJ, where the inquiry is made as to whether the towel dispenser is to be operated according to a standard program AK or according to a hygiene program AL.

After the execution of one of these programs, there is a return to AB.

The standard program AK illustrated in detail in FIG. 7*a* begins with the step AM, where 32 cm of unused towel is normally released by the first transport device. However, an economy program with a release of 27 cm of towel can be selected. The length of the released towel portion is checked by means of the revolution counter. One revolution of the worm 7*a* corresponds to approximately 3 mm of towel. Subsequently, at AN, normally 15 cm and in the economy program 10 cm of used towel is released by the second transport device. So that the front side of the loop consists solely of unused towel, less used than unused towel is dispensed. The length check is conducted in the same way as for the unused towel. The dispensing of used towel has the advantage of saving fresh towel, whilst at the same time preserving ease of use by the provision of a sufficiently large loop. The user will normally not touch the rear part of the loop and therefore not come in contact with towel used by his predecessor.

In the next step AO, it is ascertained by means of the movement sensor 20 whether the released towel has been used or not. This check will be explained in detail further below. If no use is detected, at AP the released unused towel is retracted again completely. This step obviously affords possibilities of great savings, since, especially where a trip by an infrared or other proximity sensor is concerned, faulty trips by persons passing the towel dispenser occur very easily. In the method according to the standard program, such trips without subsequent use result in no waste of unused towel. In the following step AQ, towel is drawn in by the second transport device, until it is completely tensioned and only a towel residue is still accessible.

If use is detected at AO, the check is first made at AR as to whether the towel dispenser is being operated according to a normal program or a fast program. In the latter case, at AS, unused towel, once again 32 cm in the normal case and 27 cm in the economy program, is released, and subsequently, at AT, 32 cm or 27 cm of used towel is drawn in, whereupon there is a return to AO. In the fast program, therefore, unused towel is dispensed not only before used towel is drawn in, but also without waiting for a trip. This is possible without a waste of towel only because a check is made as to whether a use takes place and, in the event of non-use, the unused towel is drawn in again, whereupon the state of rest is then assumed. It is expedient to select the fast program, above all, when a crowd is to be expected.

If the normal program has been selected, at AU used towel is drawn in as far as it will go, in the same way as at AQ. At AV, the trip mechanism is determined. If the trip is made by the infrared sensor 20, the standard program AK is abandoned and there is a return to AB, that is to say to the state of rest. If the trip is made by the movement sensor 20, 8 cm of unused towel is released beforehand at AW in order to form a short loop.

In addition to the standard program AK, there is a hygiene program AL which has been developed specially for hospitals and other environments demanding especially stringent hygiene requirements, such as, for example, food production companies, laboratories, etc. Particular importance has been placed on ensuring that the user cannot under any circumstances come into contact with a towel portion which has been touched by another user. Only fresh unused towel is made accessible to each user. Furthermore, a somewhat longer towel portion than in the standard program is provided each time.

At AX, 64 cm of unused towel is normally released. Here too, however, there is an economy program in which a portion of a length of only 54 cm is released. Thereupon, at AY, 17 cm is drawn in by the second transport device, and consequently the towel residue accessible before the trip is made inaccessible. It is ascertained at AZ whether a use has taken place. If not, at BA, 41 cm or, in the economy program, 31 cm is retracted again, whereupon, at BB, the towel is drawn in on the draw-in side as far as it will go. Here too, therefore, the saving obtained by drawing unused towel in again in the event of non-use is considerable, although it is not drawn in again completely. If no use is ascertained at AZ, the towel is drawn in as far as it will go only at BC in the same way as at BB. At all events, the check passes on to BD, where the trip mode is interrogated. In a similar way to the standard program AK, if the trip is made by the infrared sensor 32 there is an immediate return to AB, whilst if it is made by the movement sensor 20, 8 cm of unused towel is previously released at BE, so that the accessible towel residue forms a small loop.

It should also be mentioned that, since the shell 4 is usually drawn downwards by the towel 5 when unused towel is released, to protect the springs 3 the release always takes place in such a way that 2 cm of towel is additionally dispensed and drawn in again immediately thereafter. It thereby becomes possible for the shell 4 to be raised.

The detection of a use, carried out both in the standard program AK (step AO) and in the hygiene program AL (step AZ), is now explained by means of FIG. 8. At BF, a timer is set at a running time of 20 seconds. A check is made at BG as to whether the movement sensor 20 has detected a movement imparted to the towel. If not, a check is made at BH as to whether the timer is still set. If so, there is a return to BG, otherwise it is determined that no use has taken place. If it is established at BG that the towel is being moved, at BI a further timer is set at a running time of 3 seconds, and thereupon a check is made again at BJ as to whether the movement sensor 20 has detected a movement. If so, there is a return to BI that is to say the timer is reset to the start of the running time. If no movement of the towel is detected at BJ, a check is made at BK as to whether the timer is still set. If so, there is a return to BJ, otherwise a use is determined. The loops BG - BH BG and BJ - BK - BJ are each run through 64,000 times per second. Since the voltage pulses generated by the piezoelectric element 26 have a duration of at least a few milliseconds, any movement going beyond an adjustable threshold is reliably detected.

Thus, if after the formation of the loop, the towel 5 is not touched for a standby period of 20 seconds, no use is determined and the released unused towel 5 is retracted again completely (standard program AK) or partially (hygiene program AL). If the towel 5 is touched, a check is made as to whether the loop is being touched, until no movement has been detected for a waiting time of 3 seconds. The user therefore has as much time as he wishes to use the towel. Only when he has not touched it for at least 3 seconds is it established that a use has taken place and is concluded and the next step initiated.

By means of the plug 47, when it has been established at AD that the towel 5 is used up, an adjacent identical towel dispenser can be activated, and moreover various program parameters can be transferred, so that the second towel dispenser functions in exactly the same way as the first (standard/hygiene program, etc).

It is also possible to provide a transmission of information between towel dispensers and a central station either via the power line or via separate lines. Thus, information on the state of the towel dispenser, especially the towel stock, can be transmitted to the central station, and conversely commands, for example for a program change-over, to the towel dispenser.

We claim:

1. Method for the sequential provision of portions of a towel web by means of a towel dispenser, in which, starting from a state of rest in which only a towel residue is accessible, a portion of unused towel is released in response to a trip, to form or enlarge a loop hanging from a housing, and subsequently used towel is drawn into the housing and, at least when a further trip has not occurred in the meantime, the state of rest is resumed, characterised in that a selection becomes possible at least between a standard program, in which used towel as well as unused towel is released to form or enlarge the loop, the released portion of used towel being shorter than the released portion of unused towel, and a hygiene program, in which only unused towel is released to form or enlarge the loop and the towel residue is drawn in.

2. Method according to claim 1, characterised in that, in the standard program, the release of used towel takes place after the release of unused towel.

3. Method according to claim 1 or 2, characterised in that a periodic check is made by means of a movement sensor (20) as to whether the loop is being moved as a result of external action.

4. Method according to claim 3, characterised in that, at least after the formation or enlargement of the loop, use is determined if, after a movement of the loop has been detected at least once, no further detection takes place during a waiting time.

5. Method according to claim 4, characterised in that the waiting time is between 1 second and 5 seconds.

6. Method according to claim 4, characterised in that, if no use has been detected during a stand-by time, the released unused towel is at least partially retracted.

7. Method according to claim 6, characterised in that the stand-by time is between 10 seconds and 30 seconds.

8. Method according to claim 4, characterised in that, within the standard program, a selection becomes possible between a normal program, in which, after use has been determined, used towel is always drawn in and the state of rest assumed, and a fast program in which, if, after use has been determined, a further trip takes place before used towel has been drawn in, first unused towel is released and thereafter used towel is drawn in.

9. Method according to claim 3, characterised in that, in the state of rest, the towel residue forms a short loop and the trip is made as a result of the detection by the movement sensor (20) of a movement imparted to this.

10. Method according to claim 1, characterised in that, in the state of rest, the towel residue is tensioned and the trip is made by a proximity sensor which detects objects located underneath or obliquely underneath the towel dispenser.

* * * * *